United States Patent [19]

Dupre et al.

[11] 4,174,591

[45] Nov. 20, 1979

[54] APPARATUS FOR CLEANING SAND CORES

[75] Inventors: George T. Dupre, Palatine; Thomas M. DeMarco, Chicago, both of Ill.

[73] Assignee: NFE International Ltd., Palatine, Ill.

[21] Appl. No.: 898,203

[22] Filed: Apr. 20, 1978

[51] Int. Cl.[2] ..... B24B 31/00

[52] U.S. Cl. ..... 51/16; 51/418; 51/436; 51/317; 51/424

[58] Field of Search ..... 51/16, 317, 418, 425, 51/428, 436

[56] References Cited

U.S. PATENT DOCUMENTS

| | | | |
|---|---|---|---|
| 1,867,856 | 7/1932 | McCrery | 51/418 |
| 1,916,633 | 7/1933 | Mulvany | 51/418 X |
| 2,332,251 | 10/1943 | Parrish | 51/418 |
| 2,419,933 | 5/1947 | Hutchins | 51/418 |
| 3,434,241 | 3/1969 | Greenberg | 51/425 X |
| 3,694,964 | 10/1972 | Bowling | 51/425 |
| 3,921,336 | 11/1975 | Nishio | 51/418 |
| 3,934,373 | 1/1976 | Leliaert | 51/425 |

*Primary Examiner*—Gary L. Smith

*Attorney, Agent, or Firm*—Merriam, Marshall & Bicknell

[57] ABSTRACT

Apparatus for removing fins or flash from foundry sand cores, including a conveyor transporting the sand cores, means mounted above the conveyor for delivering a falling curtain of core cleaning material, such as metal shot or metal grit particles, from a reservoir onto the cores for removing the fins, means for separating the core cleaning material from loosened sand, and means for loading the reservoir with separated core cleaning material so the shot or grit can be reused. A single vacuum source and interconnecting conduits provide means for: (1) separating the shot/grit core cleaning material from loosened sand; (2) loading the reservoir with the separated shot/grit; and (3) transferring the separated loosened sand for use as needed.

13 Claims, 10 Drawing Figures

APPARATUS FOR CLEANING SAND CORES

This invention relates generally to apparatus for cleaning foundry sand cores and particularly to apparatus for removing undesired fins and other small extensions or protrusions from such cores.

BACKGROUND OF THE INVENTION

Sand cores as used for molding metal products are placed in casting cavities and openings to form passageways or hollow portions in the casting. Such cores are formed by combining sand and a binder substance, such as synthetic resins, in a core making machine having patterns or dies to shape the core. During the formation of such cores, small, fin-like extensions, known as "fins" or "flash" often develop along the junction between the core-making dies. These undesired fins must be removed or at least substantially reduced to such an extent that they do not impair the formation of the finished metal product during the casting process.

In the past, removal of the undesired fins has been accomplished manually. That is, one would normally pick up a newly formed core and scrape the fins with a wire brush or a small rigid tool, such as a file or knife to knock the fins off. This is not only time-consuming and costly, but the manual core handling often leads to the eventual destruction of a small percentage of cores due to dropping, too vigorous handling, or cracks induced during the fin knock-off procedure.

In prior attempts to clean such cores, a falling curtain of core cleaning material, such as metal shot or grit has been attempted. This cleaning technique has been demonstrated as effective on a small, batch type test operation. However, once the metal shot or grit is used, it becomes mixed with loosened sand particles and cannot be reused as an effective core cleaning material in the mixed condition due to the cushioning effect of the sand. Problems in attempts at separating the loosened sand from the metal shot or grit and transferring same to provide a workable, continuous core-cleaning system were not solved, thus leading to an eventual disregard of the metal shot curtain technique for cleaning sand cores.

Accordingly, the present invention provides a complete, continuous core-cleaning system and apparatus for economically, quickly and reliably eliminating or at least removing to a desired extent all of the fins from sand cores.

SUMMARY OF THE INVENTION

In accordance with the principles of the present invention, there is provided apparatus for cleaning the fins from sand cores utilizing a falling curtain of metal shot or grit, including apparatus for separating the loose sand from metal so that the shot and grit can be reused without the cushioning effect of sand grains. In particular, the apparatus includes a core conveyor carrying a plurality of the sand cores to be cleaned below a reservoir of metal shot wherein the metal shot is metered so as to fall in a curtain onto the sand core and thereby knock-off any fins. The falling distance of the metal shot curtain can be adjusted so as to adjust the impact force of the falling shot curtain on the fins. The apparatus includes means, including vacuum particle separator and loading means for separating the fallen shot from loosened sand, and for periodically automatically replenishing the shot reservoir and automatically transferring the loose sand to a central storage hopper.

In a preferred embodiment of the invention, the outlet or high-pressure side of the vacuum loading mechanism supplies a stream of air for separating the mixed fallen shot and loosened sand from the core conveyor. The inlet or negative pressure side of the vacuum loader is utilized to transfer the separated metal shot to shot reservoir and to transfer the periodically accumulated loose sand to a central sand hopper.

DETAILED DESCRITPION

Figures 1, 10:
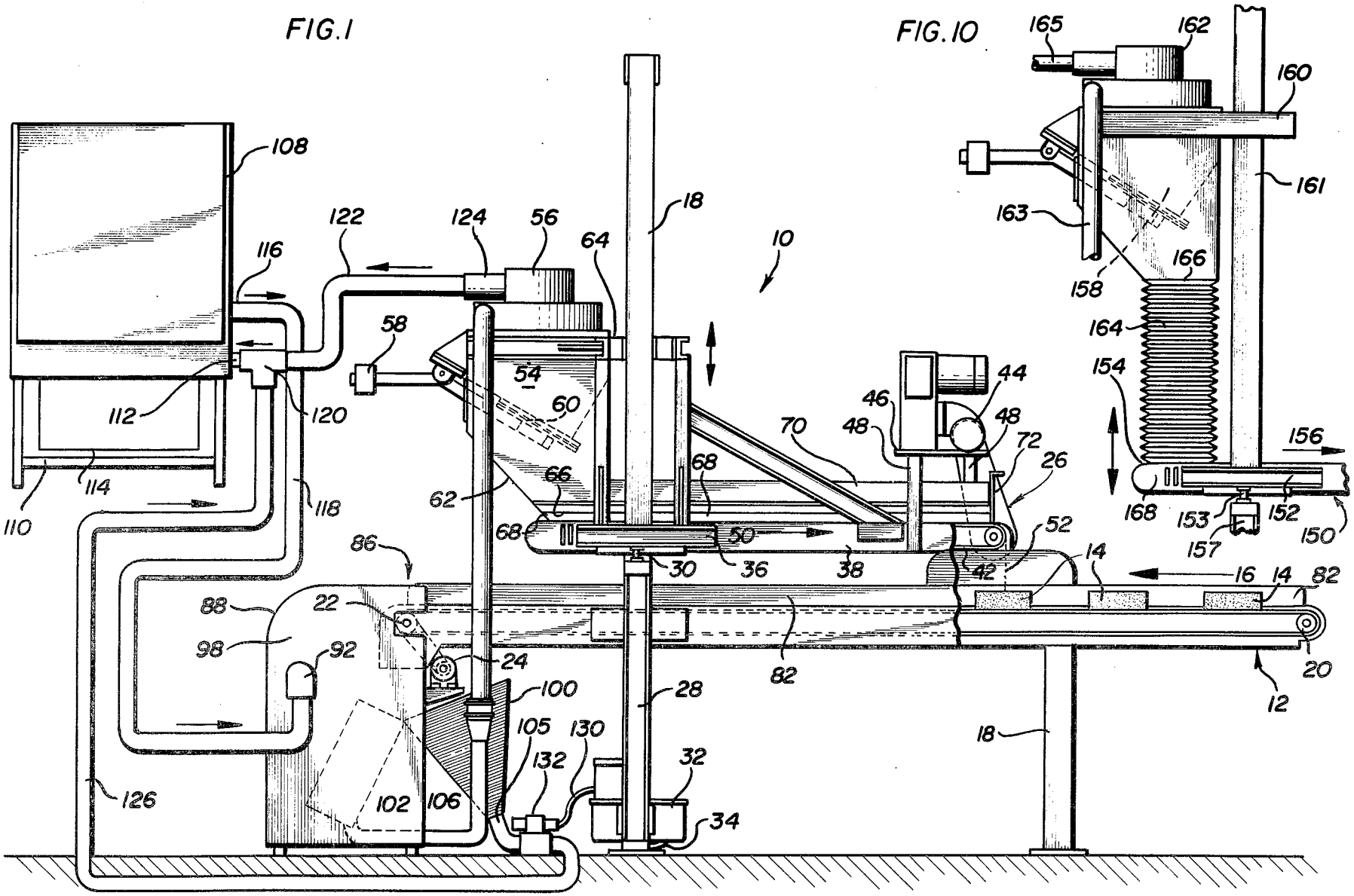
FIG. 1 is a side elevational view of a core cleaning apparatus in accordance with the principles of the present invention and including a core conveyor, a shot conveyor and a vacuum particle separator/loader.
FIG. 10 is a front elevational view of another alternative embodiment of the present invention illustrating a mounted shot hopper and a vertically adjustable shot conveyor.
Figure 3:
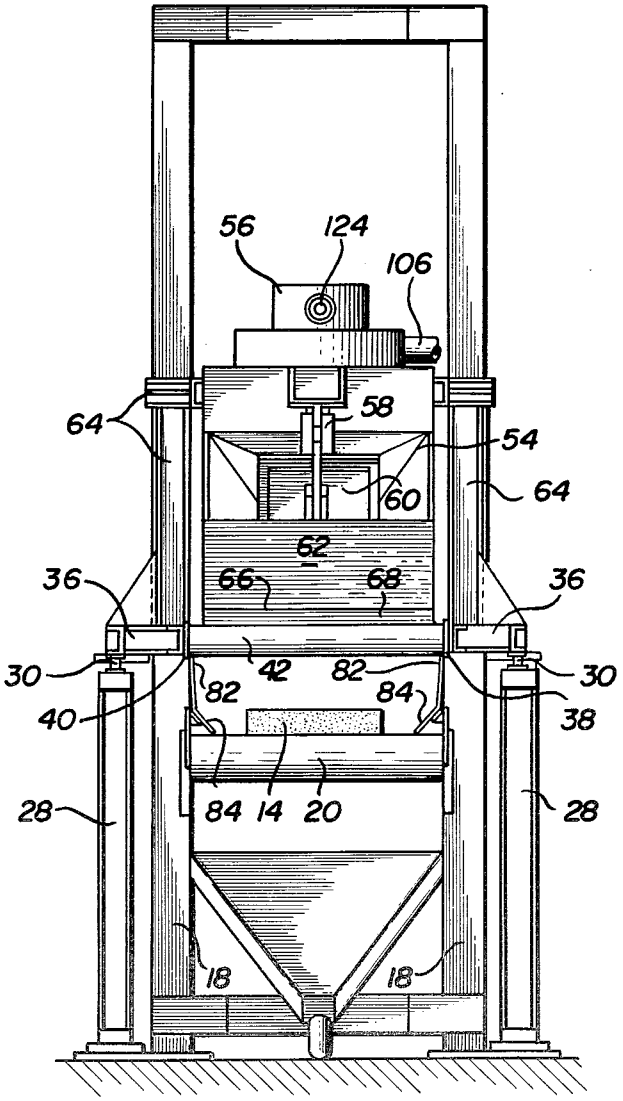
FIG. 3 is rear elevational view of the apparatus shown in FIG. 1.
Figure 2:
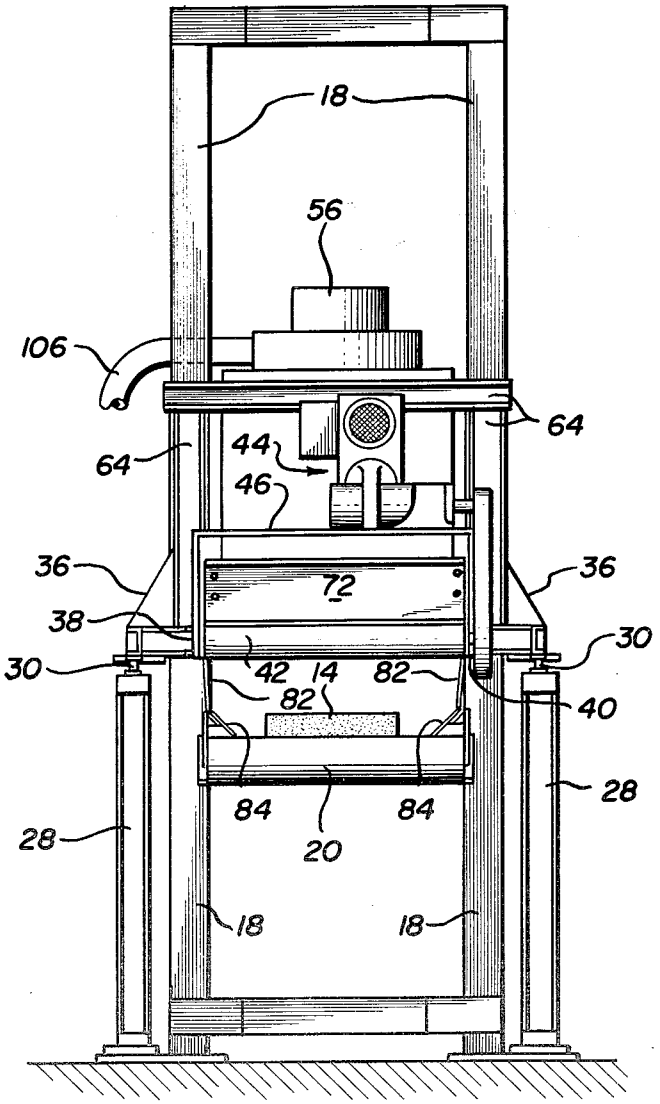
FIG. 2 is a front elevational view of the apparatus of FIG. 1.

Referring now to FIGS. 1–3, there is illustrated core cleaning apparatus 10 in accordance with the principles of the invention. The apparatus includes a core conveyor 12 for conveying a plurality of foundry sand cores 14 in the direction of arrow 16. The core conveyor 12 is rigidly mounted to a frame including support legs 18. A core conveyor belt 20 is wound around a shaft 22, with the shaft in turn being driven by a pulley and motor assembly 24.

The cores having fins or flash which are to be removed by the core cleaner apparatus 10 are individually placed on the core conveyor belt 20 at one core feed end and are removed from the conveyor belt at the other core discharge end following the cleaning procedure. The cleaned cores may be removed manually or by means of other conveyors coupled to the core dischrage end of core conveyor 20.

A shot conveyor 26 is mounted for vertical adjustment on hydraulic lift members 28. The hydraulic lift members 28 include a center rod 30 vertically extendable from a base portion by common hydraulic means such as hydraulic pressure means 32 supplying hydraulic fluid through conduit 34. The free end of each of the extendable rods 30 is rigidly mounted to a bracket 36 with the bracket in turn being mounted to respective sides 38 and 40 of the shot conveyor 26. A shot conveyor belt 42 is driven by pulley and motor means 44 mounted on a platform 46 straddling over and rididly attached by legs 48 to respective sides of the shot conveyor. The pulley and motor means 44 drive the shot conveyor belt 42 so as to move the metal shot in the direction of arrow 50 to provide a curtain 52 of metal shot to fall from one end of the shot conveyor belt onto the sand cores 14 as illustrated in FIG. 1.

At one end of the shot feed conveyor there is provided a shot batch hopper 54. Metal shot conveyed pneumatically into the top of the hopper 54 through a centrifugal inlet 56 and exits through an opening at the bottom of the hopper. The opening at the bottom of the hopper is normally covered by means of a pivoting counterweight 58 connected at one end to a seal plate 60, as shown in FIG. 3. In the views shown in FIGS. 1 and 3, the opening is maintained sealed due to a vacuum or negative pressure supplied to the interior of hopper 54 as will be hereinafter described. A shroud 62, open at its bottom, surrounds and is formed integrally with the shot hopper 54 and enables the hopper to be rigidly mounted to the shot conveyor by means of a support frame having members 64. The frame members 64 are mounted to the top of the shot feed hopper and to the bracket 36 on each side of the shot conveyor 26 to maintain the shroud bottom 66 spaced a small distance above the shot conveyor belt 42 as noted in FIG. 1. A durable, elastomeric member 68 formed, for instance, of a hard rubber material is attached to the shroud bottom 66 to form a seal between the shroud bottom 66 and the shot conveyor belt 42 so as to prevent the shot from rolling off of the belt.

A pair of skirts 70 extend from the shroud 62 and are attached to the frame members 64 on each side of the shot conveyor. A respective skirt 70 is located above one of the shot conveyor sides 38 and 40 with the space therebetween being sealed by an extension of the elastomeric member 68 to prevent the shot from falling off the shot conveyor belt as its traverses in the direction of arrow 50 from the shot hopper end towards the shot discharge end.

Figure 4:
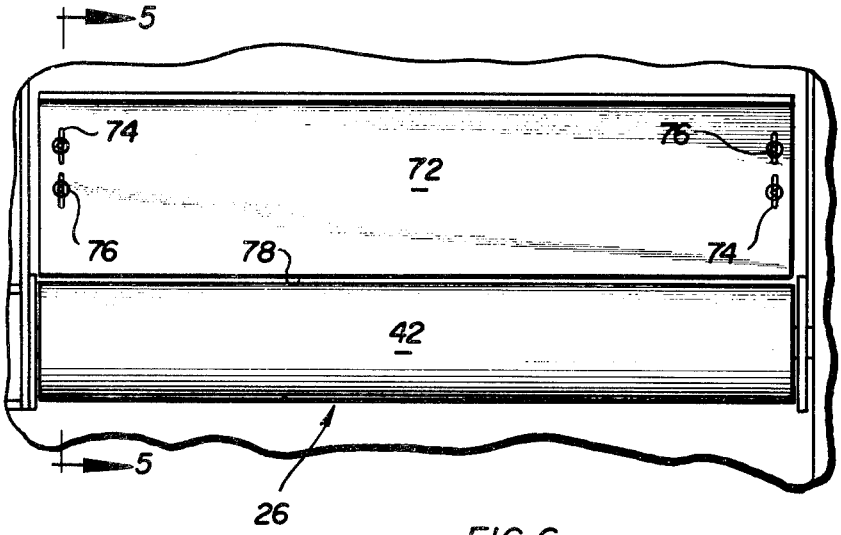
FIG. 4 is an enlarged, fragmentary front elevational view of the shot conveyor and the gate mechanism for adjusting the shot feed rate.
Figure 5:
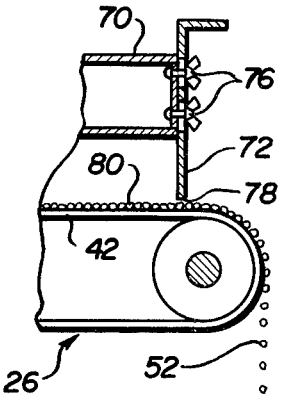
FIG. 5 is a sectional view taken along section line 5—5 of FIG. 4 illustrating the means for adjusting the shot feed rate.

Shown generally in FIGS. 1 and 2, and in more detail in FIGS. 4 and 5, a plate 72 is mounted to the skirts 70 so as to extend completely across the shot conveyor 42. The plate 72 may be adjusted vertically by means of the slot 74 and fasteners 76 to vary the position of the plate bottom end 78 with respect to the conveyor belt 42. This permits the feed rate of the shot 80 being transported by conveyor belt 42 to be adjusted to achieve the desired shot curtain 52 falling on the sand cores 14. The height of the fall of the shot curtain 52 may, of course, also be adjusted be vertically raising or lowering the shot conveyor 26 to adjust its position with respect to the sand core conveyor 12.

The shot curtain 52 falling from the shot conveyor onto the cores 14 being transported on core conveyor belt 20 are prevented from falling off of the core conveyor belt by means of a pair of side members 82 mounted on opposite sides of and extending longitudinally along the core conveyor. A longitudinal, elastomeric member 84 has one end attached to the side member 82 with the other end resting on the core conveyor belt 20 so as to form a seal and prevent the fallen shot 80 and loose sand removed from the cores 14 from falling off of the core conveyor belt 20.

As can be seen from FIG. 1, the fallen shot 80 in shot curtain 52 and the loosened sand resulting from the removal of fins or flash from the sand cores 14 is transported by the core conveyor belt 20 to a discharge end 86 of the core conveyor. Reference may now be made to the details shown in FIG. 6 wherein there is illustrated means at the core conveyor discharge end 86 for separating the fallen shot and loose sand mixture into the respective components for effective reuse. A hooded enclosure 88 includes an enclosed, elongated channel 90 extending between an inlet 92 on one side 93 of the enclosure 88 to an opposite enclosure side. An elongated plate 94 forming one side of the channel 90 and having suitable slots and wing nuts 95 can be raised or lowered to adjust the size of a longitudinal slit 96. Thus, if air under pressure is supplied to the inlet 99, the air will be guided by channel 90 so as to exit from slit 96 as a generally horizontal airstream 98. The directivity of airstream 98 is therefore adjustable by varying the opening of slit 96. As an alternative, an elongated pipe with a series of aligned orifices can be mounted in enclosure 88 to extend from inlet 92 to the opposite side of the enclosure. The pipe also can be rotatably mounted so as to vary the position of the airstream 98.

Figure 6:
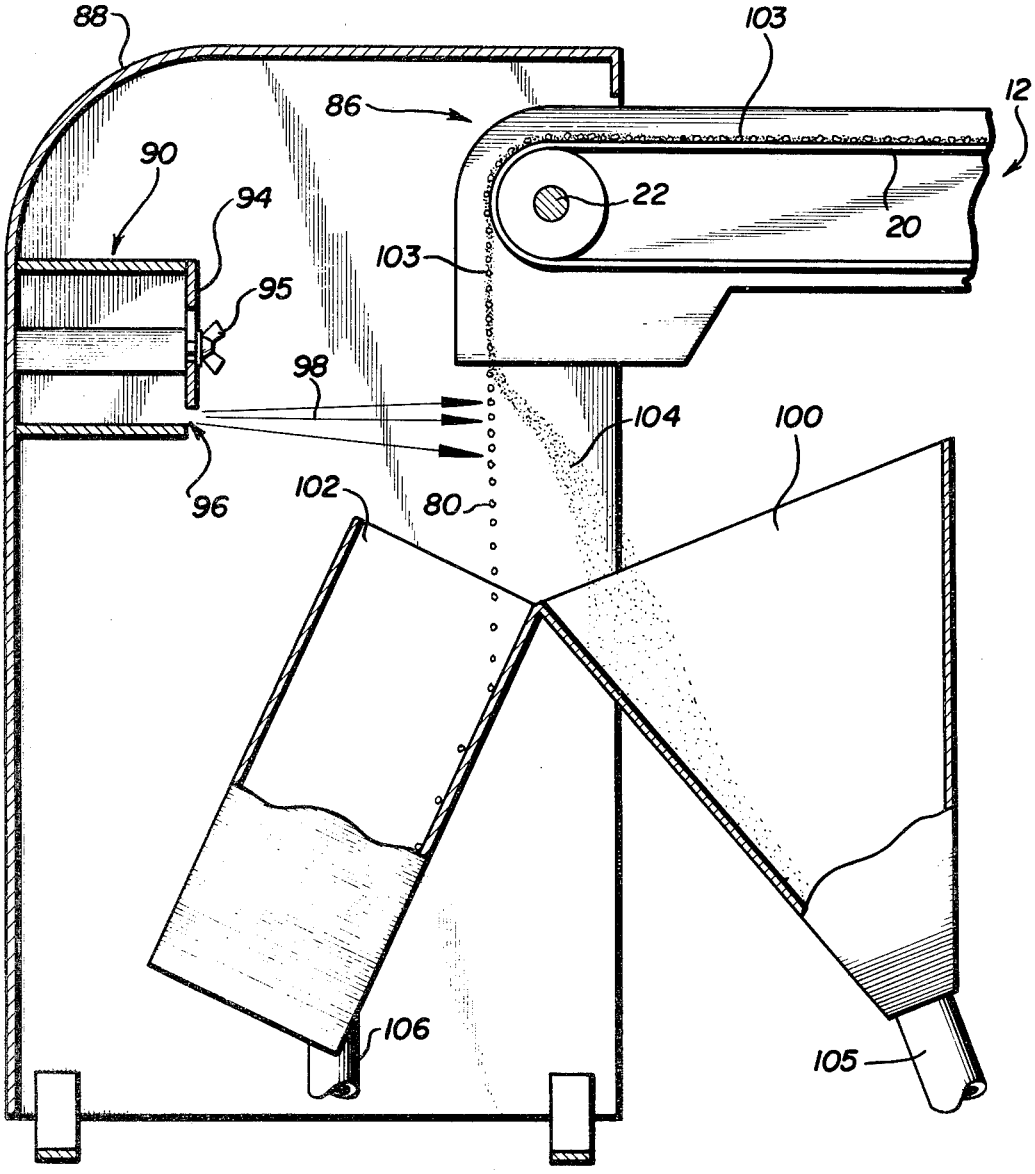
FIG. 6 is a fragmentary, side elevational view, partly cut away illustrating the core conveyor and means for separating the fallen metal shot and loose sand.

A sand receptacle 100 and a metal receptacle 102 are suitable mounted with their respective open tops at the discharge end 86 of core conveyor 12. As can be seen in FIG. 6, the metal shot receptacle 102 is located substantially directly beneath the path of the sand and shot mixture 103 falling from the core conveyor discharge end 86. On the other hand, the sand receptacle 100 is mounted slightly beyond the discharge end 86 such that the airstream 98 will tend to move the lighter weighted loosened sand particles 104 towards the open top of the sand receptacle 100. It is to be understood, of course, that the heavier weighted metal shot 80 is relatively unaffected by the airstream 98 and therefore falls substantially vertically after leaving the end of conveyor belt 20 directly into the shot receptacle 102.

Thus, the mixture 103 of loosened sand 104 and metal shot 80 on conveyor belt 20 is readily separated for later reuse and can be withdrawn from the bottom of the respective receptacles by means of respective conduits 105 and 106. Conduit 105 is connected to a vacuum source for transferring the loosened sand from receptacle 100 to a larger storage container for eventual reuse of the sand. Conduit 106 is connected to a vacuum source for transfer of the metal shot 80 accumulated in the shot receptacle 102 to the shot batch hopper 54 for reuse as core cleaning material.

Reference may now be made to FIG. 1 wherein there is illustrated automated means for transferring the accumulated sand in sand receptacle 100 to a central location; for transferring the accumulated shot in shot receptacle 102 to the shot batch hopper 54; and for transferring the shot in shot batch hopper 54 to the shot conveyor belt 42. In addition, in a preferred embodiment of the invention, the same automated means also provide an airstream into inlet 92 for separating the shot 80 from the loosened sand 104 in the separation technique shown and previously described in detail in connection with FIG. 6.

Referring now to FIG. 1, a vacuum loader 108, comprising a vacuum source with a blower and having one or more particle separator stages capable of separating particulate material from an airstream, is mounted on a frame 110 and includes an inlet 112. Airborn particulate material coupled to inlet 112 will be separated from the airstream by the vacuum loader or separator 108. The separated particulate material is deposited in a hopper 114 removably mounted on the frame 110 below the separator 108. The clean airstream exits the separator at outlet 116, which outlet is coupled by a conduit 118 to the channel inlet 92 to provide the airstream 98 for separating the sand from shot as shown in FIG. 6.

The vacuum particle separator inlet 112 is coupled to a T-connector 120. One branch of T-connector 120 is connected through a conduit 122 to the air outlet port 124 of the centrifuge 56. The other branch of T-connector 120 is connected through a conduit 126 to a valve 128 with the valve in turn being coupled to the conduit 105 connected to the sand receptacle 100. It is preferred that the valve 128 comprise a standard, well-known automatically operable valve, such as a hydraulic or pneumatic unit which can be selectively opened and closed to selectively connect the sand receptacle 100 to the vacuum separator inlet 112. In FIG. 1, for instance, the valve 128 is indicated as a hyraulic valve interconnected by hydraulic line 130 to the hydraulic pressure means 32. A standard, well-known timer unit 132 can be set at different "on" and "off" times to operate in conjunction with the hydraulic pressure on line 130 so as to provide the desired opened and closed intervals for the valve 128.

During normal operation of the core cleaning apparatus 10, the valve 128 is selectively cycled between its opened and closed positions. As an example, if the valve 128 is in the closed position, metal shot in the shot receptacle 102 is drawn up conduit 106 and deposited into the batch hopper 54. Air is being drawn from inside the shot hopper 54 through conduit 122 to the input 112 of the vacuum particle separator 108. This negative pressure or vacuum condition in shot hopper 54 and the action of counter-weight 58 maintains the seal 60 in a closed position at the bottom of the hopper. Thus, shot is continuously being transferred from the shot receptacle 102 to the shot hopper 54 via conduit 106. In the meantime, sand 104 separated from the shot 80 is being deposited and collected in the sand receptacle 100.

If the valve 128 is now opened, the accumulated sand in sand receptacle 100 is coupled through conduit 126 to the vacuum particle separator input 112 and deposited in hopper 114. This also places an atmospheric pressure condition at the T-connector 120, thereby also coupling atmospheric pressure to the interior of shot hopper 54. This action sufficiently raises the pressure inside hopper 54 to enable the weight of the accumulated metal shot 80 in the hopper 54 to overcome the seal 60 closing force due to the counterweight 58. Thus, the shot accumulated to that point in shot hopper 54 is automatically unloaded from the hopper and dumped onto the shot conveyor belt 42. As soon as the pressure is equalized both inside and outside the hopper 54, the counterweight 58 again acts to place seal 60 in a closed condition at the bottom hopper opening. At this point, the valve 128 is again closed and the shot from shot receptacle 102 is again transferred into the feed hopper 54.

As can be seen from the above, the shot accumulated in feed hopper 54 is batch fed to the shot conveyor 42. Plate 72 at the opposite shot conveyor end acts both to adjust the rate of flow and to smooth out the batches to insure that a continuous curtain 52 of metal shot is dropped on the sand cores 14 across the width of the core conveyor belt 20.

The metal shot is a commercially available item and may be substantially rounded and have a diameter between about 1/32 inch to 3/32 inch. In the alternative, commercially available metal grit can be used, i.e. angular, fine, flat, blast cleaning type metal particles. In any event the height of the shot conveyor above the core conveyor can be adjusted so that the fins or flash can be substantially removed from the cores by the falling curtain of metal shot or grit without unduly harming the core surface.

Since the shot feed conveyor 26 is vertically adjustable, the conduits 122 and 106 can be constructed of a flexible, hose type material. Such flexible hoses are standard, commercially available items. Also readily available are various types of couplers for attaching the ends of such flexible hoses to the various inlets and outlets mentioned herein as well as for coupling the hoses to rigid conduits.

Figure 8:
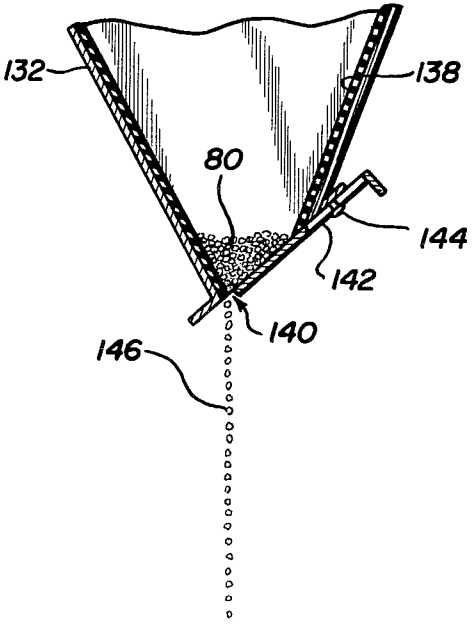
FIG. 8 is a side elevational view of the shot feed hopper of FIG. 7, partly cut away to illustrate the shot feed rate adjustment.
Figure 7:
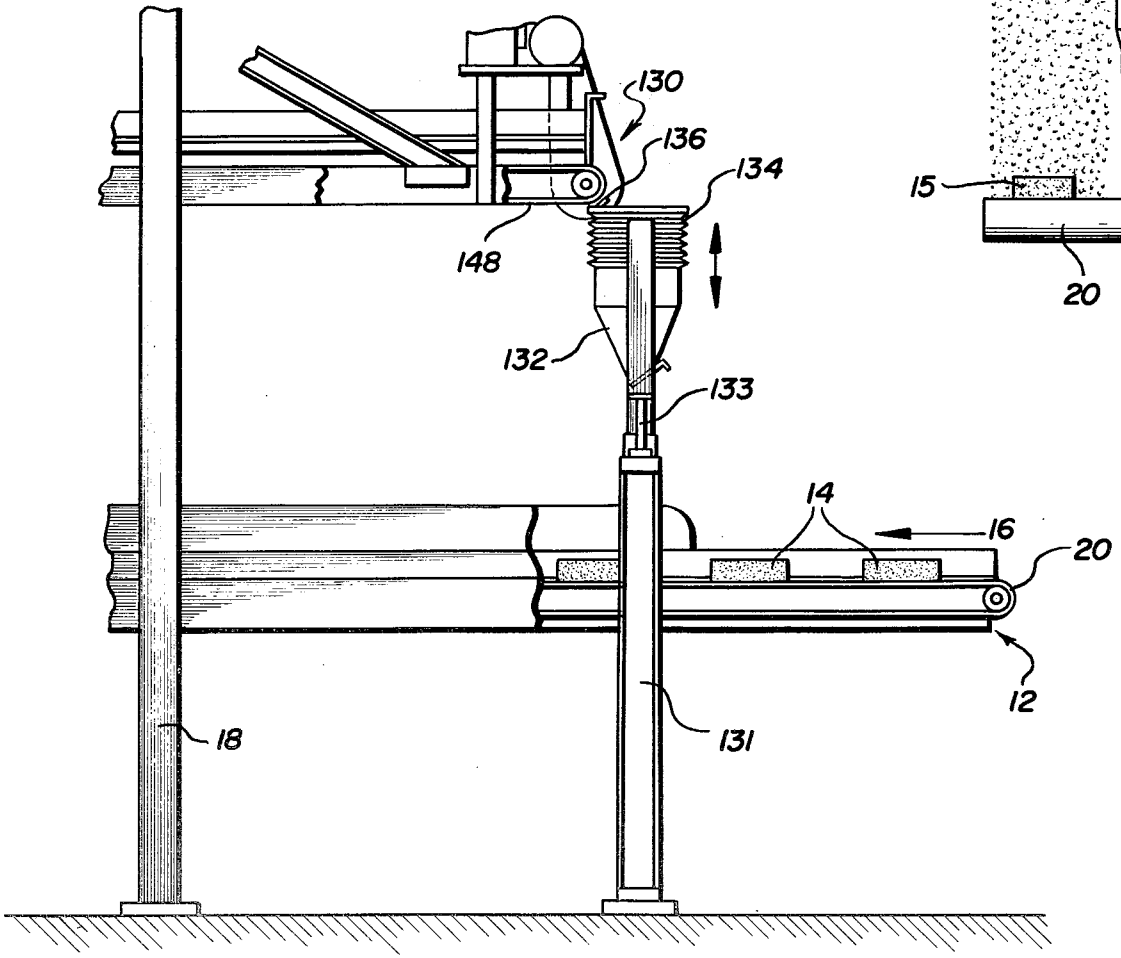
FIG. 7 is a fragmentary, side elevational view of an alternative embodiment of the present invention including a core conveyor, a shot conveyor and an intermediate vertically adjustable shot and grit feed hopper.

Referring now to FIGS. 7 and 8, there is illustrated an alternative embodiment of the invention. In this embodiment, the core conveyor 12 transporting the main cores 14 in the indicated direction 16 is rigidly fixed in position by a series of platform legs in a similar manner to that shown in FIG. 1. However, in this alternative embodiment, rather than being vertically adjustable, a shot conveyor 130 is also fixed rigidly in position such as by being mounted to the same platform legs 18. The shot conveyor 130 in FIG. 7 can be of a construction similar to the vertically adjustable shot conveyor 26 as shown in FIG. 1 and also include a similar shot hopper 54 and centrifugal inlet 56.

As noted in FIG. 7, a hydraulic lift member 131 includes an extending center rod 133 mounted through suitable support means to a variable height, intermediate shot feed hopper 132. An expandable, corregated member 134 has one end mounted to the top of the intermediate hopper 132 and an upper end mounted through a bracket 136 to a frame member on the fixed shot conveyor 130. Thus, it is apparent that the hopper 132 may be raised and lowered in vertical position so as to vary the vertical distance between the bottom of the hopper and the sand cores 14.

Reference may be made to FIG. 8 whrein there is illustrated the intermediate shot hopper 132 in partial sectional view showing the details of a rubber lining 138 on the interior surface of the hopper. At the bottom of the hopper there is provided an elongated slit opening 140 which is defined and can be varied in dimension by positioning a plate 142 and locking the plate in position by means of a fastener 144. The plate 142 may be adjusted to provide an elongated slit opening 140 such that the metal shot 80 entering the interior of the hopper as it is fed from the shot conveyor 130 is supplied in a steady shot curtain 146. It is to be understood that the shot conveyor 130 shown in FIG. 7 is constructed in a similar manner to the shot conveyor 26 shown in FIG. 1 and that the metal shot or grit can be batch fed onto the conveyor belt 148 from a shot hopper similar to the hopper 54 shown in FIG. 1.

Thus, comparing the embodiment of FIGS. 7 and 8 with the embodiment shown in FIGS. 1–6, the intensity or force of the falling shot curtain on the cores is varied by adjusting the height of intermediate shot hopper 132 above the core conveyor as opposed to varying the height of the shot conveyor 26 with respect to the core conveyor. It may also be noted that in connection with the embodiments shown in FIGS. 7 and 8, the conduits 106 and 122 now may be rigid rather than flexible since shot conveyor 130 is fixed in position.

Figure 9:
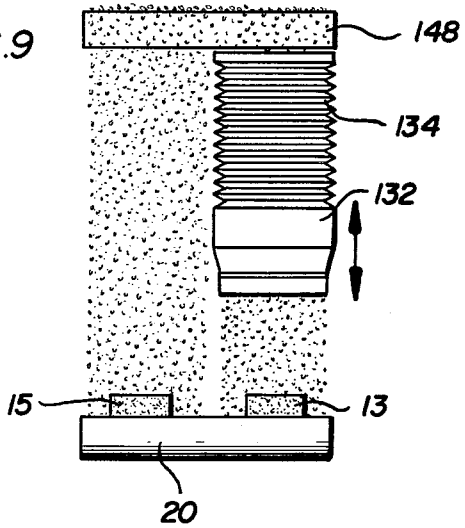
FIG. 9 is a schematic representation of a front elevational view showing a modification of the embodiment of FIGS. 7 and 8 useful in cleaning fins from both "hard" and "soft" sand cores as they are known in the trade.

Also, the embodiment shown in FIGS. 7 and 8 can be modified so as to clean two different types of cores simultaneously, i.e. both "soft" cores and "hard" cores as they are known in the trade. That is, in the schematic representation shown in FIG. 9, the soft cores 13 are placed along the right half portion of the core conveyor belt 20 and the hard cores 15 are placed along the left hand portion of the belt. The intermediate shot hopper 132 located so as to receive shot from the right hand portion of shot conveyor belt 148 and direct the shot only to the soft cores 13 on the right hand portion of the belt 20, whereas the metal shot falling from the left hand portion of belt 148 would fall directly from the belt 148 onto the hard cores 15 on the left hand portion of belt 20.

Referring now to FIG. 10, there is illustrated another alternative embodiment of the present invention. In this embodiment, a shot conveyor 150 is mounted through bracket means such as a bracket 152 to a center rod 151 of a hydraulic lift unit 153 of the type previously described. The shot conveyor 150 includes a driven belt for moving metal shot left to right as shown in FIG. 10 from a feed end 154 towards a shot discharge end as represented by the direction reference arrow 156. A shot batch hopper 158 similar in construction to hopper 54 is mounted by means of support members 160 in a rigid manner to the platform legs 160. A conduit 163 feeds metal shot to the top centrifuge 162 and conduit 165 is coupled to a vacuum particle separator in the same manner as illustrated in FIG. 1 in connection with shot hopper 54. However, it may be noted that in the embodiment of FIG. 10, shot hopper 158 is fixed in position so that the conduits 163 and 165 can be rigid members rather than flexible hoses.

Also, there is no necessity in the embodiment of FIG. 10 to move the entire shot hopper, counterweight and coupling conduits when adjusting the vertical position of shot conveyor 150. Note that in the embodiment of FIG. 1, the shot hopper 54 and the shot conveyor 26 move together as a unit. An expandable, corrugated flexible member 164 is attached to the bottom perimeter 166 of the feed hopper and to the shot conveyor sides 168 in order to guide the metal shot dropped from hopper 158 to shot conveyor 150.

A metal mesh core conveyor can be substituted for the core conveyor belt 20 to allow the fallen metal shot or grit and loosened sand to pass through the mesh conveyor. The shot or grit can then be separated from sand below the mesh core conveyor using the horizontal airstream technique shown in FIGS. 1 and 6, or by using a vibrating table. Separation of shot from sand may also be accomplished by utilizing the differences in the resiliency characteristics of metal shot and sand particles. If the shot and sand mixture is dropped onto an inclined plane, the metal shot will bounce over a positioned opening in the inclined plane, whereas the sand has a lower "bounce rate" and will therefore fall through the opening and thereby be separated from the shot.

A commercially available unit suitable for use as a vacuum loader and particle separator 108 is available from NFE International, Ltd., the assignee herein, under the trademark HI-VAC, and is described in U.S. Pat. No. 3,780,502.

The foregoing detailed description has been given for clearness of understanding only, and no unnecessary limitations should be understood therefrom as modifications will be obvious to those skilled in the art.

What is claimed is:

1. Apparatus for removing fins from foundry sand cores comprising:

conveyor means, including a moving core conveyor for transporting said sand cores;

cleaning means mounted above said conveyor means, including a core cleaning material reservoir, for delivering a falling curtain of said cores cleaning material onto said sand cores for removing said fins;

separator means for separating said cleaning material from loosened sand resulting from removal of said fins;

loading means for receiving said separated cleaning material from said separator means and loading said cleaning material reservoir for reuse of said core cleaning material;

said loading means including respective cleaning material and sand receptacles for receiving said respective separated particles from said separator means, a vacuum source coupled to said cleaning material reservoir and a conduit interconnecting said cleaning material reservoir and said cleaning material receptacle to convey cleaning material in said receptacle to said reservoir; and said cleaning means including a cleaning material conveyor mounted intermediate said cleaning material reservoir and said core conveyor, and means for periodically interrupting the transfer of said cleaning material from said receptacle to said cleaning material reservoir to deposit the periodically accumulated cleaning material in said reservoir onto said cleaning material conveyor.

2. Apparatus for removing fins from foundry sand cores comprising:

conveyor means, including a moving core conveyor for transporting said sand cores;

cleaning means mounted above said conveyor means, including a core cleaning material reservoir, for delivering a falling curtain of said core cleaning material onto said sand cores for removing said fins;

separator means for separating said cleaning material from loosened sand resulting from removal of said fins;

loading means for receiving said separated cleaning material from said separator means and loading said cleaning material reservoir for reuse of said core cleaning material;

said loading means including respective cleaning material and sand receptacles for receiving said respective separated particles from said separator means, a vacuum source coupled to said cleaning material reservoir and a conduit interconnecting said cleaning material reservoir and said cleaning material receptacle to convey cleaning material in said receptacle to said reservoir; and a respective conduit interconnecting said vacuum source to said sand receptacle for conveying sand in said receptacle to said vacuum source.

3. Sand core cleaning apparatus according to claim 2, including valve means intermediate said sand receptacle and said vacuum source, and means for periodically operating said valve to intermittently convey sand from said receptacle to said vacuum source and simultaneously deposit said cleaning material from said cleaning material reservoir to said cleaning material conveyor.

4. Apparatus for removing fins from foundry sand cores comprising:

conveyor means, including a moving core conveyor for transporting said sand cores;

cleaning means mounted above said conveyor means, including a core cleaning material reservoir, for delivering a falling curtain of said core cleaning material onto said sand cores for removing said fins;

separator means for separating said cleaning material from loosened sand resulting from removal of said fins;

loading means for receiving said separated cleaning material from said separator means and loading said cleaning material reservoir for reuse of said core cleaning material;

said cleaning means including a cleaning material conveyor mounted intermediate said cleaning material reservoir and said core conveyor, said cleaning material conveyor having a cleaning material receiving end and an opposite cleaning material discharge end for receiving cleaning material from said reservoir at said receiving end and delivering said cleaning material at said delivery end in the form of a falling curtain onto said sand cores for removing said fins; and means for vertically moving said cleaning material conveyor with respect to said core conveyor so as to vary the falling height of said falling curtain of core cleaning material onto said cores.

5. Sand core cleaning apparatus according to claim 4, including means for rigidly mounting said cleaning material reservoir to said cleaning material conveyor.

6. Sand core cleaning apparatus according to claim 4, wherein said cleaning material conveyor is vertically movable with respect to said cleaning material reservoir.

7. Apparatus for removing fins from foundry sand cores comprising:

conveyor means, including a moving core conveyor for transporting said sand cores;

cleaning means mounted above said conveyor means, including a core cleaning material reservoir, for delivering a falling curtain of said core cleaning material onto said sand cores for removing said fins;

separator means for separating said cleaning material from loosened sand resulting from removal of said fins;

loading means for receiving said separated cleaning material from said separator means and loading said cleaning material reservoir for reuse of said core cleaning material;

said cleaning means including a cleaning material conveyor mounted intermediate said cleaning material reservoir and said core conveyor, said cleaning conveyor having a cleaning material receiving end and an opposite cleaning material discharge end for receiving cleaning material from said reservoir at said receiving end and delivering said cleaning material at said delivery end in the form of a falling curtain onto said sand cores for removing said fins; and said cleaning means further including a vertically adjustable hopper mounted at said cleaning material conveyor discharge end intermediate said cleaning material conveyor and said core conveyor, said hopper including a slit opening at the bottom thereof for receiving said falling curtain of said core cleaning material and directing same onto said sand cores for removing said fins.

8. Sand core cleaning apparatus according to claim 7, wherein said hopper is mounted so as to receive less than the full width of said falling curtain of core cleaning material from said cleaning material conveyor whereby the falling curtain from said hopper falls from a height less than the falling curtain from said cleaning material conveyor.

9. Apparatus for removing fins from foundry sand cores comprising:

a frame;

a core conveyor mounted to said frame having a receiving end for receiving said sand cores and an opposite discharge end;

core conveyor drive means drivingly connected to said core conveyor for transporting said sand cores from said core conveyor receiving end to the core conveyor discharge end;

a cleaning material conveyor mounted to said frame above said core conveyor having a cleaning material receiving end and a cleaning material delivery end;

means for supplying cleaning material to said cleaning material receiving end of said cleaning material conveyor;

a cleaning material conveyor drive means drivingly connected to said cleaning material conveyor for transporting said cleaning material from said cleaning material receiving end to the cleaning material discharge end and providing a falling curtain of said cleaning material onto said sand cores for removing said fins; and means for vertically adjusting the position of said cleaning material conveyor with respect to said core conveyor so as to vary the height of said falling curtain of cleaning material onto said sand cores.

10. Apparatus for removing fins from foundry sand cores comprising:

a frame;

a core conveyor mounted to said frame having a receiving end for receiving said sand cores and an opposite discharge end;

core conveyor drive means drivingly connected to said core conveyor for transporting said sand cores from said core conveyor receiving end to the core conveyor discharge end;

a cleaning material conveyor mounted to said frame above said core conveyor having a cleaning material receiving end and a cleaning material delivery end;

means for supplying cleaning material to said cleaning material receiving end of said cleaning material conveyor;

a cleaning material conveyor drive means drivingly connected to said cleaning material conveyor for transporting said cleaning material from said cleaning material receiving end to the cleaning material discharge end and providing a falling curtain of said cleaning material onto said sand cores for removing said fins; and a vertically adjustable hopper mounted at said cleaning material conveyor discharge end intermediate said cleaning material conveyor and said core conveyor, said hopper including a slit opening at the bottom thereof for receiving said falling curtain of said core cleaning material and directing same onto said sand cores for removing said fins.

11. Sand core cleaning apparatus according to claim 10, wherein said hopper is mounted so as to receive less than the full width of said falling curtain of core cleaning material from said cleaning material conveyor whereby the falling curtain from said hopper falls from a height less than the falling curtain from said cleaning material conveyor.

12. Apparatus for removing fins from foundry sand cores comprising:

a frame;

a core conveyor mounted to said frame having a receiving end for receiving said sand cores and an opposite discharge end;

core conveyor drive means drivingly connected to said core conveyor for transporting said sand cores from said core conveyor receiving end to the core conveyor discharge end;

a cleaning material reservoir mounted to said frame above said core conveyor for delivering a falling curtain of said core cleaning material onto said sand cores for removing said fins;

separator means mounted to said frame at said core conveyor discharge end for separating said cleaning material from loosened sand resulting from removal of said fins;

a first container receiving said separated cleaning material at said core conveyor discharge end;

a second container receiving said separated loosened sand at said core conveyor discharge end;

a vacuum source having a suction input;

respective conduits interconnecting said vacuum source suction input to said second container and to said cleaning material reservoir, and interconnecting said first container to said cleaning material reservoir; and means for selectively enabling said vacuum source to transfer cleaning material in said first container to said cleaning material reservoir via said respective conduit, and to transfer sand in said second container to said vacuum source input.

13. Apparatus for removing fins from foundry sand cores comprising:

a frame;

a core conveyor mounted to said frame having a receiving end for receiving said sand cores and an opposite discharge end;

core conveyor drive means drivingly connected to said core conveyor for transporting said sand cores from said core conveyor receiving end to the core conveyor discharge end;

a cleaning material conveyor mounted to said frame above said core conveyor having a cleaning material receiving end and a cleaning material delivery end;

a cleaning material conveyor drive means drivingly connected to said cleaning material conveyor for transporting said cleaning material from said cleaning material receiving end to the cleaning material discharge end and providing a falling curtain of said cleaning material onto said sand cores for removing said fins;

a cleaning material reservoir mounted to said frame for selectively supplying said cleaning material in batches to the cleaning material receiving end of said cleaning material conveyor;

separator means mounted to said frame at said core conveyor discharge end for separating said cleaning material from loosened sand resulting from removal of said fins as said cleaning material and loosened sand fall from the core conveyor discharge end;

a first container receiving said separated cleaning material at said sand core conveyor discharge end;

a second container receiving said separated loosened sand at said core conveyor discharge end;

a vacuum source having a suction input;

a first conduit interconnecting said vacuum source suction input to said cleaning material reservoir;

a second conduit interconnecting said vacuum source suction input to said second container;

a third conduit interconnecting said first container to said cleaning material reservoir;

said vacuum source transferring said cleaning material from said first container through said third conduit to said cleaning material reservoir to accumulate cleaning material therein; and valve means coupled to said vacuum source suction input for periodically (1) interrupting the transfer of said cleaning material from said first container to said cleaning material reservoir, (2) transferring said accumulated cleaning material in said reservoir to said cleaning material receiving end of said cleaning material conveyor, and (3) transferring sand from said second container to said vacuum source suction input.

* * * * *